US011286134B2

(12) United States Patent
Montigny et al.

(10) Patent No.: US 11,286,134 B2
(45) Date of Patent: Mar. 29, 2022

(54) ELEVATOR CAR DOOR COUPLING SYSTEMS

(71) Applicant: Otis Elevator Company, Farmington, CT (US)

(72) Inventors: Guillaume Montigny, Gien (FR); Fabrice Hamon, Les Choux (FR); Sebastien Fougeron, Lorris (FR); Jerome Bertrand, St Firmin des Bois (FR); Alexandre Renard, Coullons (FR); Clement Schach, Orléans (FR); Romain Gaudot, Gien (FR); Jerome Marais, Saint Firmin sur Loire (FR); Stephane Brieuc, Poilly Lez Gien (FR); Laurie Babot, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 389 days.

(21) Appl. No.: 16/403,938

(22) Filed: May 6, 2019

(65) Prior Publication Data

US 2019/0345005 A1 Nov. 14, 2019

(30) Foreign Application Priority Data

May 9, 2018 (EP) ..... 18305569

(51) Int. Cl.
*B66B 13/06* (2006.01)
*B66B 11/02* (2006.01)
(Continued)

(52) U.S. Cl.
CPC ..... *B66B 13/06* (2013.01); *B66B 11/02* (2013.01); *B66B 13/12* (2013.01); *B66B 13/18* (2013.01)

(58) Field of Classification Search
CPC ..... B66B 13/12; B66B 13/02; B66B 13/18
See application file for complete search history.

(56) References Cited

U.S. PATENT DOCUMENTS 5,538,106 A 7/1996 McHugh et al.
5,732,796 A 3/1998 Ahigian et al.
(Continued)

FOREIGN PATENT DOCUMENTS

CN 1120514 A 4/1996
CN 1196028 A 10/1998
(Continued)

OTHER PUBLICATIONS

European Search Report for European Application No. 18305569.8, International Filing Date May 9, 2018, dated Nov. 29, 2018, 7 pages.

*Primary Examiner* — Diem M Tran
(74) *Attorney, Agent, or Firm* — Cantor Colburn LLP

(57) ABSTRACT

Elevator car door systems are provided. The systems include an elevator car having a car door and a movable car door coupling attached to the car and arranged to control operation of the car door. A mounting bracket is attached to the car, a first blade is attached to the mounting bracket, a second blade is attached to the mounting bracket, and a deterrent is attached to the mounting bracket. The first and second blades are operable a landing door coupling to operate the car door. A portion of the movable car door coupling is arranged to contact a ceiling of an elevator shaft during an overrun event when and move a part of the movable car door coupling relative to the car, and when the portion is not in contact with the ceiling, a biasing element urges the portion toward a normal position.

18 Claims, 12 Drawing Sheets

(51) Int. Cl.
*B66B 13/12* (2006.01)
*B66B 13/18* (2006.01)

(56) References Cited

U.S. PATENT DOCUMENTS

| | | | | |
|---|---|---|---|---|
| 7,100,745 | B2 | 9/2006 | Bisang et al. | |
| 7,413,058 | B2 | 8/2008 | Zappa | |
| 8,973,714 | B2 | 3/2015 | Utsunomiya et al. | |
| 9,260,275 | B2 | 2/2016 | Reuter et al. | |
| 9,302,886 | B2 | 4/2016 | Tantis et al. | |
| 9,637,350 | B2 | 5/2017 | Mittermayr | |
| 9,663,329 | B2 | 5/2017 | Zappa | |
| 9,834,413 | B2 | 12/2017 | Mittermayr | |
| 2004/0251087 | A1 | 12/2004 | Huber et al. | |
| 2008/0007271 | A1 | 1/2008 | Smith et al. | |
| 2012/0048657 | A1* | 3/2012 | Christen | B66B 13/301 187/330 |
| 2013/0105249 | A1 | 5/2013 | Henseler | |
| 2013/0133985 | A1* | 5/2013 | Reuter | B66B 13/12 187/319 |

FOREIGN PATENT DOCUMENTS

| | | | | |
|---|---|---|---|---|
| CN | 102666349 | A | 9/2012 | |
| CN | 103079983 | A | 5/2013 | |
| CN | 203998555 | U | 12/2014 | |
| CN | 207001975 | U | 2/2018 | |
| FR | 2823495 | A1 * | 10/2002 | B66B 13/20 |
| FR | 2823495 | A1 | 10/2002 | |
| WO | 9737923 | A1 | 10/1997 | |
| WO | 2009078837 | A1 | 6/2009 | |

* cited by examiner

ELEVATOR CAR DOOR COUPLING SYSTEMS

CROSS REFERENCE TO RELATED APPLICATIONS

This application claims the benefit of European Application No. 18305569.8, filed May 9, 2018, which is incorporated herein by reference in its entirety.

BACKGROUND

The subject matter disclosed herein generally relates to elevator systems and, more particularly, to elevator car door systems and elevator car door couplings thereof.

Elevators are equipped with car door couplings to enable operation of an elevator car door in conjunction with a landing door during normal operation. The couplings of such systems are located at the top of the doors. The components of the elevator car doors are located on the exterior of the elevator car and within an elevator shaft. Typically such components extend above a top of the elevator car. It may be advantageous to reduce the footprint or volume occupied by elevator systems, and thus reducing the required space to accommodate the elevator car couplings may be desirable.

SUMMARY

According to some embodiments, elevator car door systems are provided. The elevator car door systems include an elevator car having an elevator car door and a movable elevator car door coupling attached to the elevator car and arranged to control operation of the elevator car door. The movable elevator car door coupling includes a mounting bracket attached to the elevator car, a first blade attached to the mounting bracket, a second blade attached to the mounting bracket, and a deterrent attached to the mounting bracket. The first and second blades are operable to engage with a landing door coupling to operate the elevator car door. A portion of the movable elevator car door coupling is arranged to contact a ceiling of an elevator shaft during an overrun event, wherein, when the portion contacts the ceiling, at least a part of the movable elevator car door coupling moves relative to the elevator car, and when the portion is not in contact with the ceiling, a biasing element urges the portion toward a normal position.

In addition to one or more of the features described above, or as an alternative, further embodiments of the elevator car door systems may include that the portion comprises the first blade.

In addition to one or more of the features described above, or as an alternative, further embodiments of the elevator car door systems may include a first blade support fixedly connected to the mounting bracket, wherein the first blade is moveably connected to the first blade support.

In addition to one or more of the features described above, or as an alternative, further embodiments of the elevator car door systems may include that the biasing element connects the first blade to the first blade support.

In addition to one or more of the features described above, or as an alternative, further embodiments of the elevator car door systems may include at least one connector arranged to moveably connect the first blade to the first blade support.

In addition to one or more of the features described above, or as an alternative, further embodiments of the elevator car door systems may include that the first blade support defines a slot and the at least one connector moves along the slot when the first blade is moved due to contact with the ceiling of the elevator shaft.

In addition to one or more of the features described above, or as an alternative, further embodiments of the elevator car door systems may include that the at least one connector includes a connector extension arranged to maintain a separation of the first blade from the second blade.

In addition to one or more of the features described above, or as an alternative, further embodiments of the elevator car door systems may include that the portion comprises the deterrent.

In addition to one or more of the features described above, or as an alternative, further embodiments of the elevator car door systems may include a deterrent support fixedly connected to the mounting bracket, wherein the deterrent is moveably connected to the deterrent support.

In addition to one or more of the features described above, or as an alternative, further embodiments of the elevator car door systems may include that the biasing element connects the first blade to the first blade support.

In addition to one or more of the features described above, or as an alternative, further embodiments of the elevator car door systems may include at least one connector arranged to moveably connect the first blade to the first blade support.

In addition to one or more of the features described above, or as an alternative, further embodiments of the elevator car door systems may include that the first blade support defines a slot and the at least one connector moves along the slot when the first blade is moved due to contact with the ceiling of the elevator shaft.

In addition to one or more of the features described above, or as an alternative, further embodiments of the elevator car door systems may include that the portion comprises a bracket extension of the mounting bracket.

In addition to one or more of the features described above, or as an alternative, further embodiments of the elevator car door systems may include a secondary mounting bracket, wherein the secondary mounting bracket is fixedly connected to the elevator car and the mounting bracket is movably mounted to the secondary mounting bracket.

In addition to one or more of the features described above, or as an alternative, further embodiments of the elevator car door systems may include that the biasing element connects the mounting bracket to the secondary mounting bracket.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
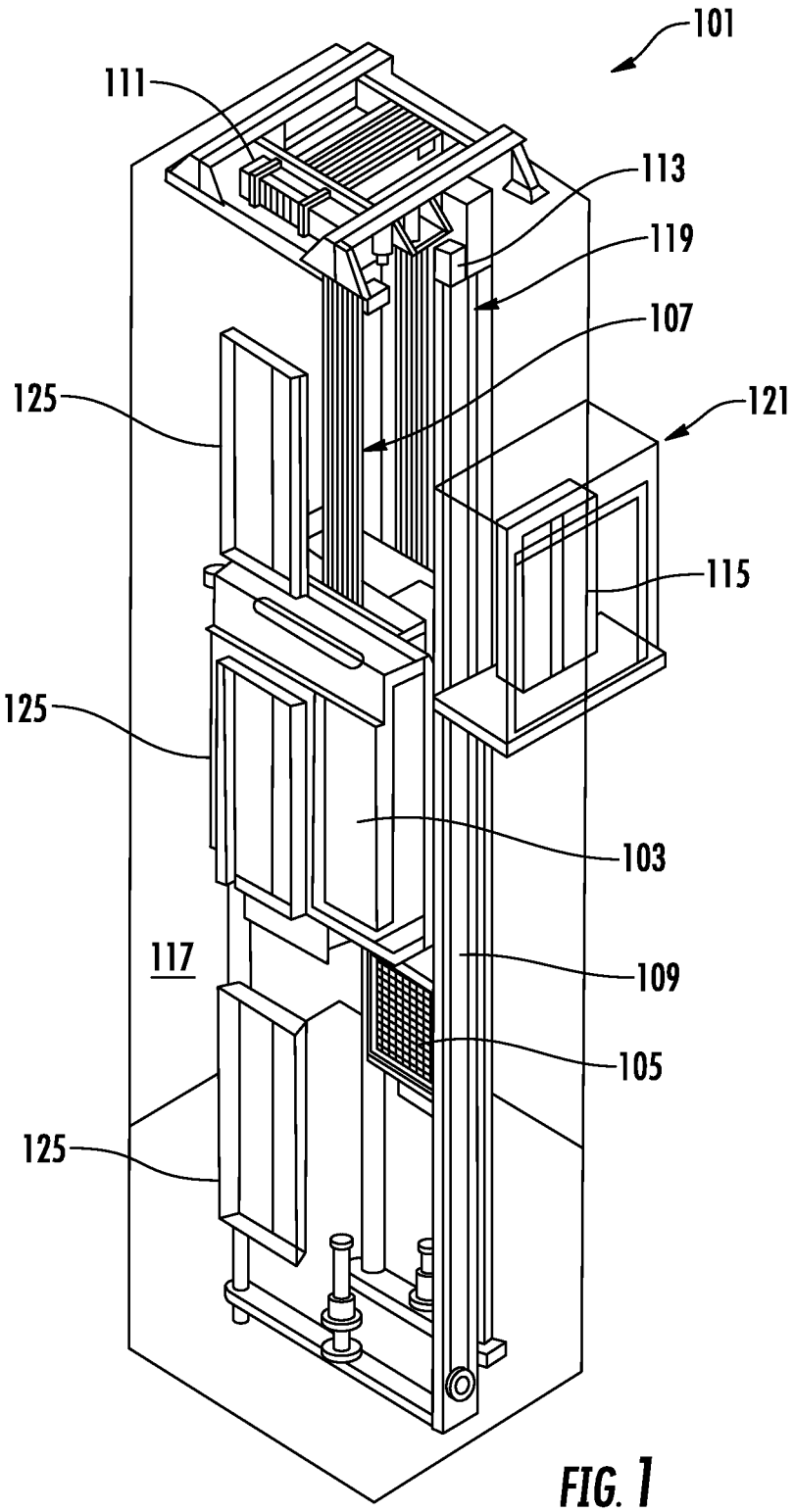
FIG. 1 is a schematic illustration of an elevator system that may employ various embodiments of the present disclosure.

FIG. 1 is a perspective view of an elevator system 101 including an elevator car 103, a counterweight 105, a roping 107, a guide rail 109, a machine 111, a position encoder 113, and an elevator controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which, in this illustrative embodiment, is part of an overhead structure of the elevator system 101, although other arrangements are possible without departing from the scope of the present disclosure. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The elevator controller 115 is located, as shown in the illustrative arrangement, in a controller room 121 of the elevator shaft 117 and is configured to control the operation of the elevator system 101, and particularly the elevator car 103. In other embodiments the controller 115 can be located in other locations, including, but not limited to, fixed to a landing or landing door or located in a cabinet at a landing. The elevator controller 115 may provide drive signals to the machine 111 to control the acceleration, deceleration, leveling, stopping, etc. of the elevator car 103. The elevator controller 115 may also be configured to receive position signals from the position encoder 113. When moving up or down within the elevator shaft 117 along guide rail 109, the elevator car 103 may stop at one or more landings 125 as controlled by the elevator controller 115.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

Figure 2:
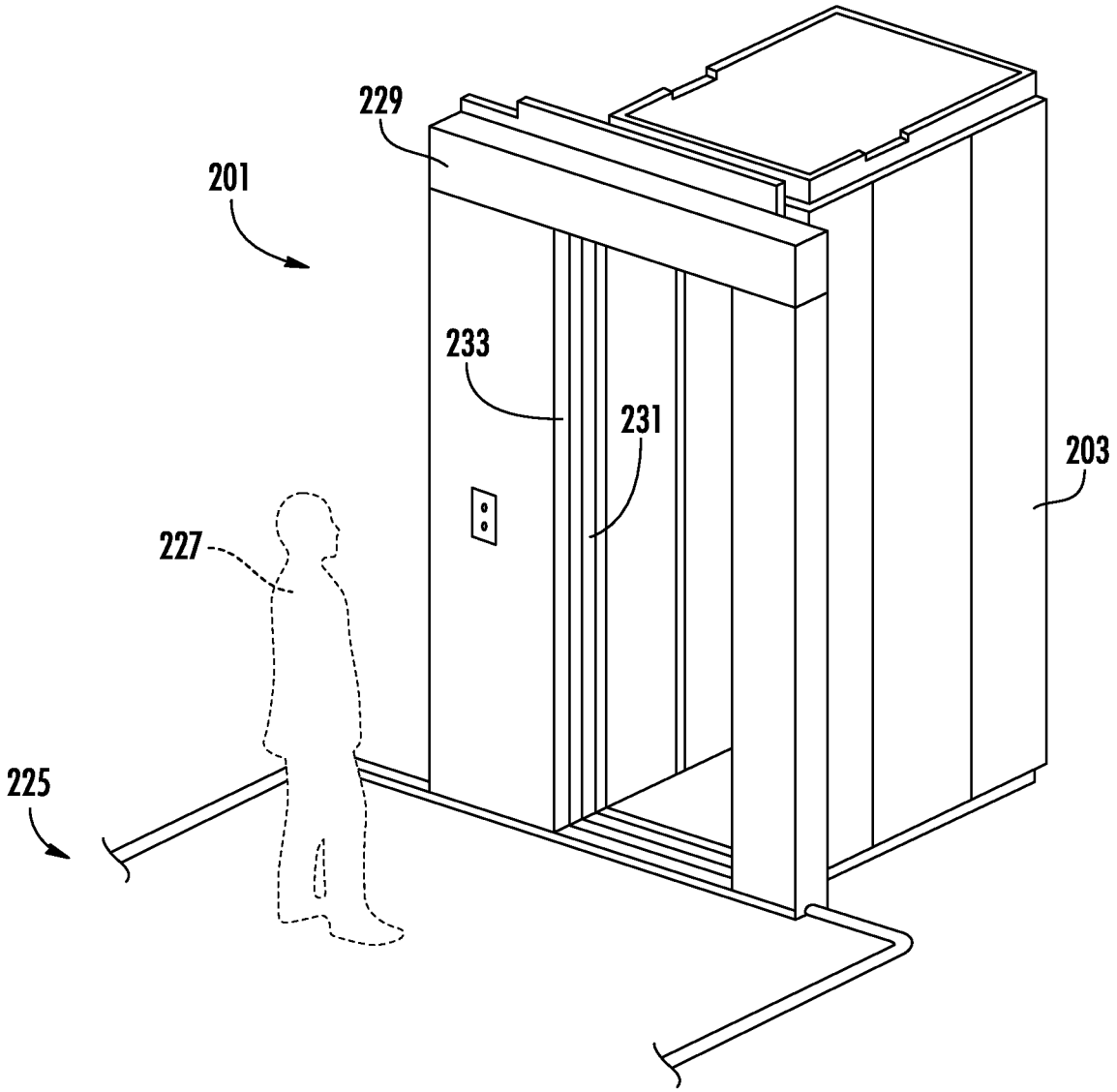
FIG. 2 is a schematic illustration of a landing floor of an elevator system with a hall call panel that may employ various embodiments of the present disclosure.

FIG. 2 is a schematic illustration of an elevator system 201 that may incorporate embodiments disclosed herein. As shown in FIG. 2, an elevator car 203 is located at a landing 225. The elevator car 203 may be called to the landing 225 by a passenger or mechanic 227 that desires to travel to another floor within a building or perform maintenance on a portion of the elevator system 201. The elevator car 203 includes car doors 231 and the landing 225 includes landing doors 233. When the elevator car 203 is located at the landing 225, an opening operation can be performed wherein a component of the car doors 231 will engage with a component of the landing doors 233 to open both sets of doors 231, 233 and then enable ingress and egress between the elevator car 203 and the landing 225.

A landing door lintel 229 of the elevator system 201 (which may be located at one or more landings 225) can house various of the components of the doors to enable operation thereof. For example, operational components for locking/unlocking of the landing doors 233 and the car doors 231 (e.g., couplings) may be located behind the lintel, with the operational components of the landing doors 233 being located within the landing door lintel 229 and the operational components of the car doors 231 being located on the elevator car 203 and arranged to interact with the landing door components, as will be appreciated by those of skill in the art. Typically, the coupling elements of the elevator car doors will extend above the elevator car.

It is advantageous to reduce the volume or footprint of an elevator system within a building. To accommodate such reductions, the amount of space located above and below an elevator car at the top and bottom of an elevator shaft may be reduced. As such, the components and equipment installed and located on top of the elevator car may be required to have altered configurations or otherwise accommodate such reductions in available space.

In accordance with embodiments of the present disclosure, movable elevator car door couplings are described herein. The elevator car door couplings of the present disclosure are arranged to remain in the traditional location relative to an elevator car during normal operation. However, when the elevator car approaches the top of the elevator shaft, such as in an over-run situation, the elevator car door couplings are movable to prevent damage thereto, thus allowing for reduced footprint of the elevator system within a building.

Figure 3B:
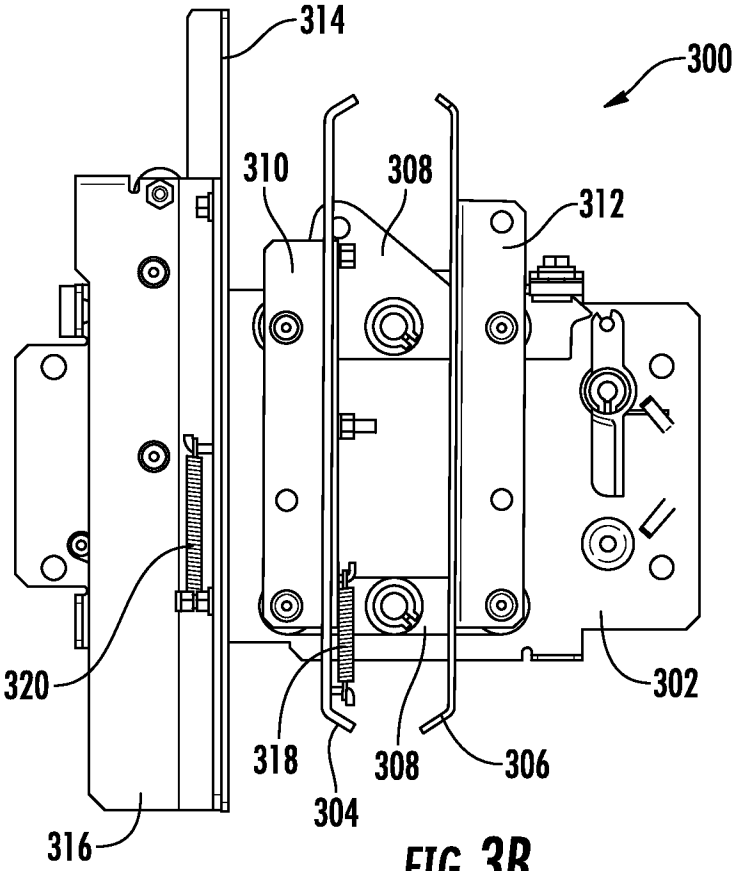
FIG. 3B illustrates the movable elevator car door coupling of FIG. 3A in an unlocked position.
Figure 3A:
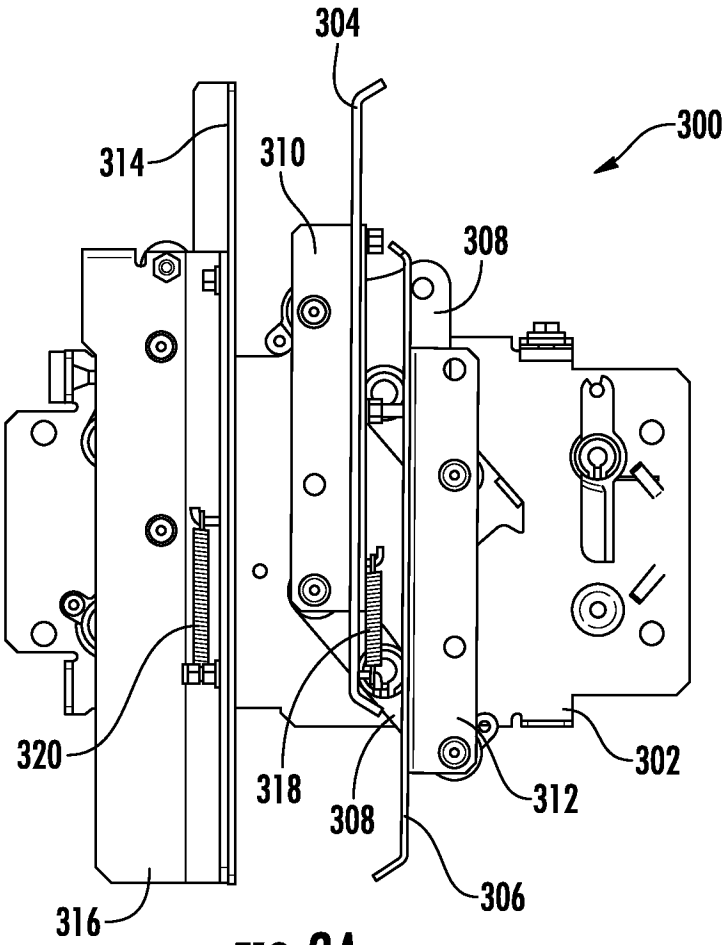
FIG. 3A illustrates a movable elevator car door coupling in accordance with an embodiment of the present disclosure in a locked position.

Turning now to FIGS. 3A-3B, schematic illustrations of a movable elevator car door coupling 300 in accordance with an embodiment of the present disclosure are shown. The movable elevator car door coupling 300 is arranged to be mounted and fixed to an elevator car and is arranged to allow for coupling with a landing door coupling, as will be appreciated by those of skill in the art. FIG. 3A illustrates the movable elevator car door coupling 300 in a locked position and FIG. 3B illustrates the movable elevator car door coupling 300 in an unlocked position, e.g., after engagement and/or actuation with a landing door coupling.

The movable elevator car door coupling 300 includes a mounting bracket 302 that fixedly attaches or connects to the elevator car. Attached to the mounting bracket 302 are a first blade 304 and a second blade 306. The blades 304, 306 are movably mounted to the mounting bracket 302 by one or more pivot mounts 308. The pivot mounts 308 are rotatable about a pivot or fixed point that is attached to the mounting bracket 302. The first blade 304 is connected to a first blade support 310 and the second blade 306 is connected to a second blade support 312. The blade supports 310, 312 may be directly connected to the pivot mounts 308, and the blades 304, 306 may be arranged to interact with components of a landing door lock mechanism and/or landing door coupling, as will be appreciated by those of skill in the art. In some embodiments, the second blade 306 and the second blade support 312 may be a unitary body.

Further, as shown, a deterrent 314 is arranged relative to the blades 304, 306 to prevent access to the blades 304, 306 and thus prevent unauthorized or improper operation of the movable elevator car door coupling 300, and thus prevent unauthorized or improper opening of an elevator car door. The deterrent 314, in this embodiment, is movably mounted to a deterrent support 316. The deterrent support 316 is fixedly attached to the mounting bracket 302.

As shown in FIG. 3A, during normal operation, in a locked position, the first blade 304 and the deterrent 314 extend above the mounting bracket 302. The extension of these elements may interact with or contact a ceiling of an elevator shaft. However, in this embodiment, the first blade 304 and the deterrent 314 are movably attached to the movable elevator car door coupling 300 to enable movement of such components when contact is made with a ceiling of an elevator shaft. To allow for the movement of the first blade 304 and the deterrent 314, biasing elements are provided. For example, as shown, the first blade 304 is connected to the first blade support 310 by a first biasing element 318 and the deterrent 314 is connected to the deterrent support 316 by a second biasing element 320. In normal operation, as shown in FIGS. 3A-3B, the biasing elements 318, 320 do not impact or affect operation of the movable elevator car door coupling 300. That is, the biasing elements 318, 320 do not interfere with operation of the couplings and elevator door operations. However, as described herein, if an overrun event or other situation occurs wherein the elevator car approaches the top of the elevator shaft, the biasing elements 318, 320 enable portions of the movable elevator car door coupling 300 to move to prevent damage thereto.

Figure 4A:
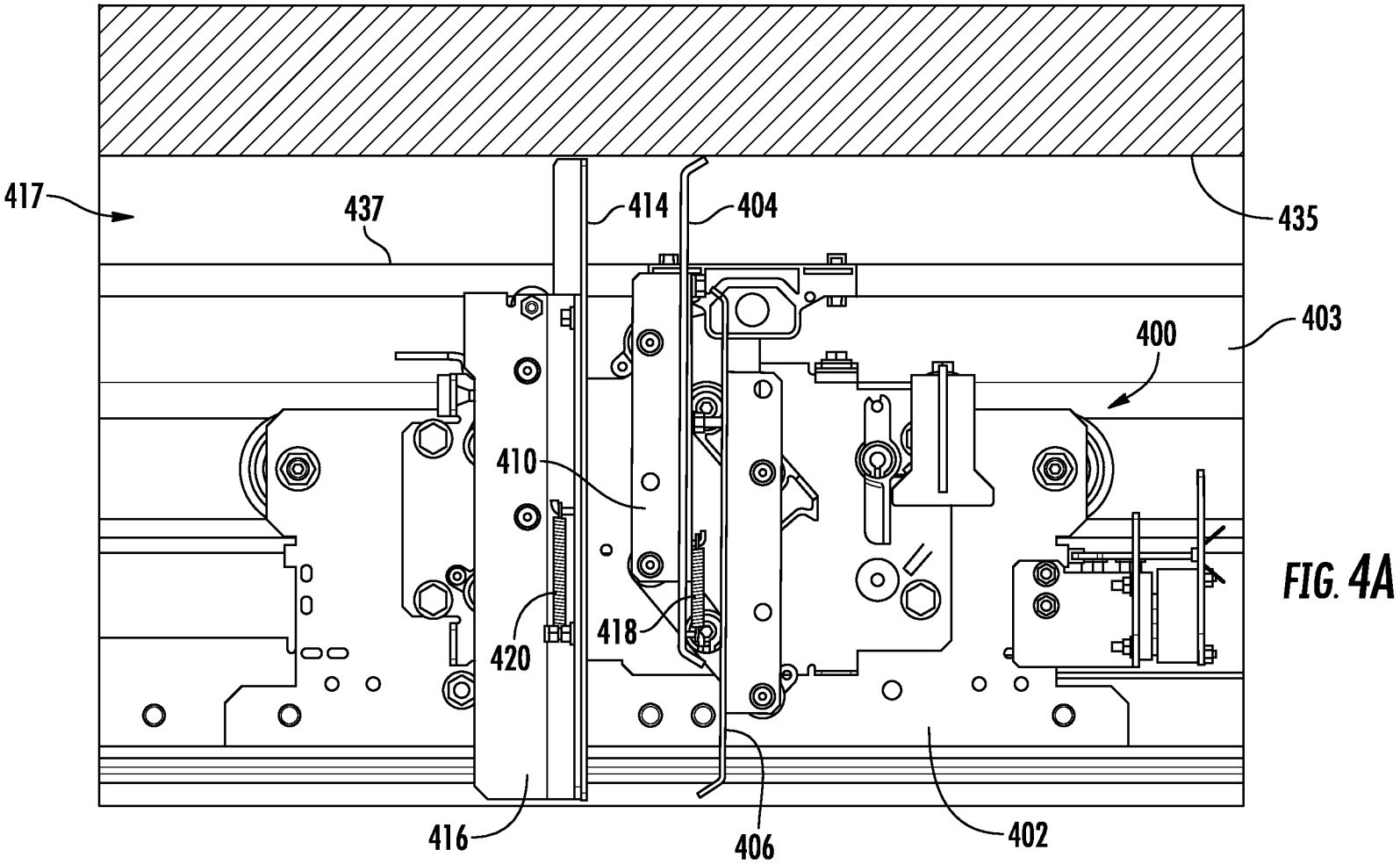
FIG. 4A illustrates a movable elevator car door coupling in accordance with an embodiment of the present disclosure in a first position, at the start of contact with a ceiling of an elevator shaft.
Figure 4B:
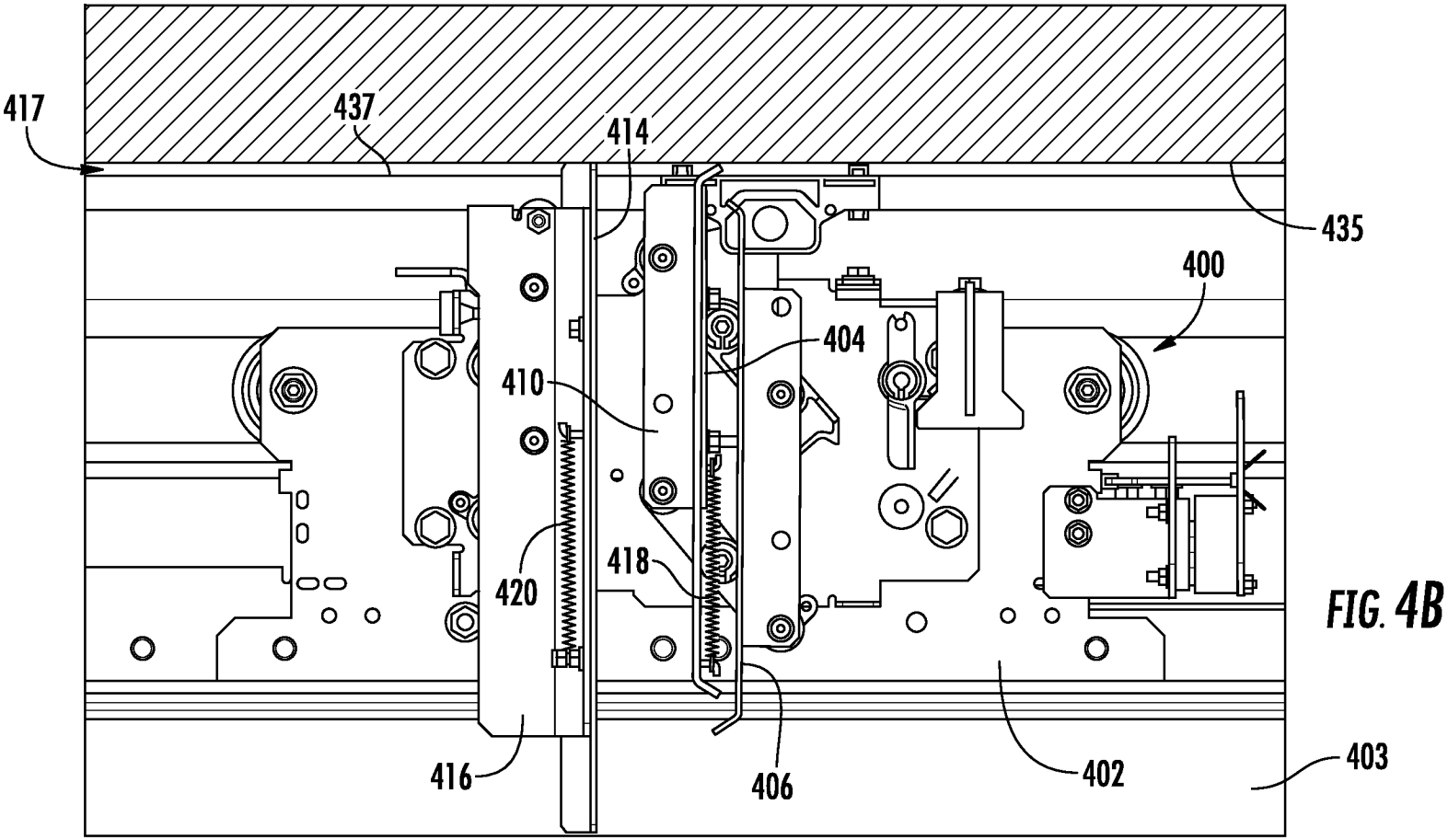
FIG. 4B illustrates the movable elevator car door coupling of FIG. 4A in a second position, after contact and further movement of the elevator car occurs.

For example, turning now to FIGS. 4A-4B, schematic illustrations of a movable elevator car door coupling 400 mounted to an elevator car 403 in accordance with an embodiment of the present disclosure are shown. FIG. 4A illustrates the movable elevator car door coupling 400, in a first position, at the start of contact with a ceiling 435 of an elevator shaft 417. FIG. 4B illustrates the movable elevator car door coupling 400 in a second position, after contact and further movement of the elevator car 403 occurs. As shown in FIG. 4B, parts of the movable elevator car door coupling 400 move to allow for the movement of the elevator car 403 relative to the ceiling 435.

The movable elevator car door coupling 400 is similar to that shown and described above. For example, the movable elevator car door coupling 400 includes a mounting bracket 402 that mounts the movable elevator car door coupling 400 to the elevator car 403. The movable elevator car door coupling 400 includes a first blade 404 and a second blade 406, as described above. The first blade 404 is movably connected to a first blade support 410 with a first biasing element 418 arranged therebetween. Similarly, a deterrent 414 is movably attached to a deterrent support 416 by a second biasing element 420. As shown, in the normal operation position (FIG. 4A), the first blade 404 and the deterrent 414 extend above a top 437 of the elevator car 403.

However, during an overrun event, such as shown in FIG. 4B, the first blade 404 and the deterrent 414 are moved relative to the elevator car 403 to allow the top 437 of the elevator car 403 to move closer to the ceiling 435 of the elevator shaft 417. As shown in FIG. 4B, the biasing elements 418, 420 are extended to allow for the first blade 404 and the deterrent 414 to move relative to the elevator car 403 (i.e., the elements move downward relative to the top 437 of the elevator car 403). In this embodiment, the first blade 404 and the deterrent 414 contact the ceiling 435 of the elevator shaft 417, which forces the first blade 404 and the deterrent 414 to move, applying pressure or force against the biasing elements 418, 420. The extended biasing elements 418, 420 will apply a biasing force such that when the elevator car 403 moves away from the ceiling 435 of the elevator shaft 417, the first blade 404 and the deterrent 414 will be returned to the normal position (shown in FIG. 4A). That is, the biasing elements 418, 420 apply a restoring force to return the first blade 404 and the deterrent 414 to the normal operation position after an overrun or other contact and force is applied to the first blade 404 and the deterrent 414.

Figure 5A:
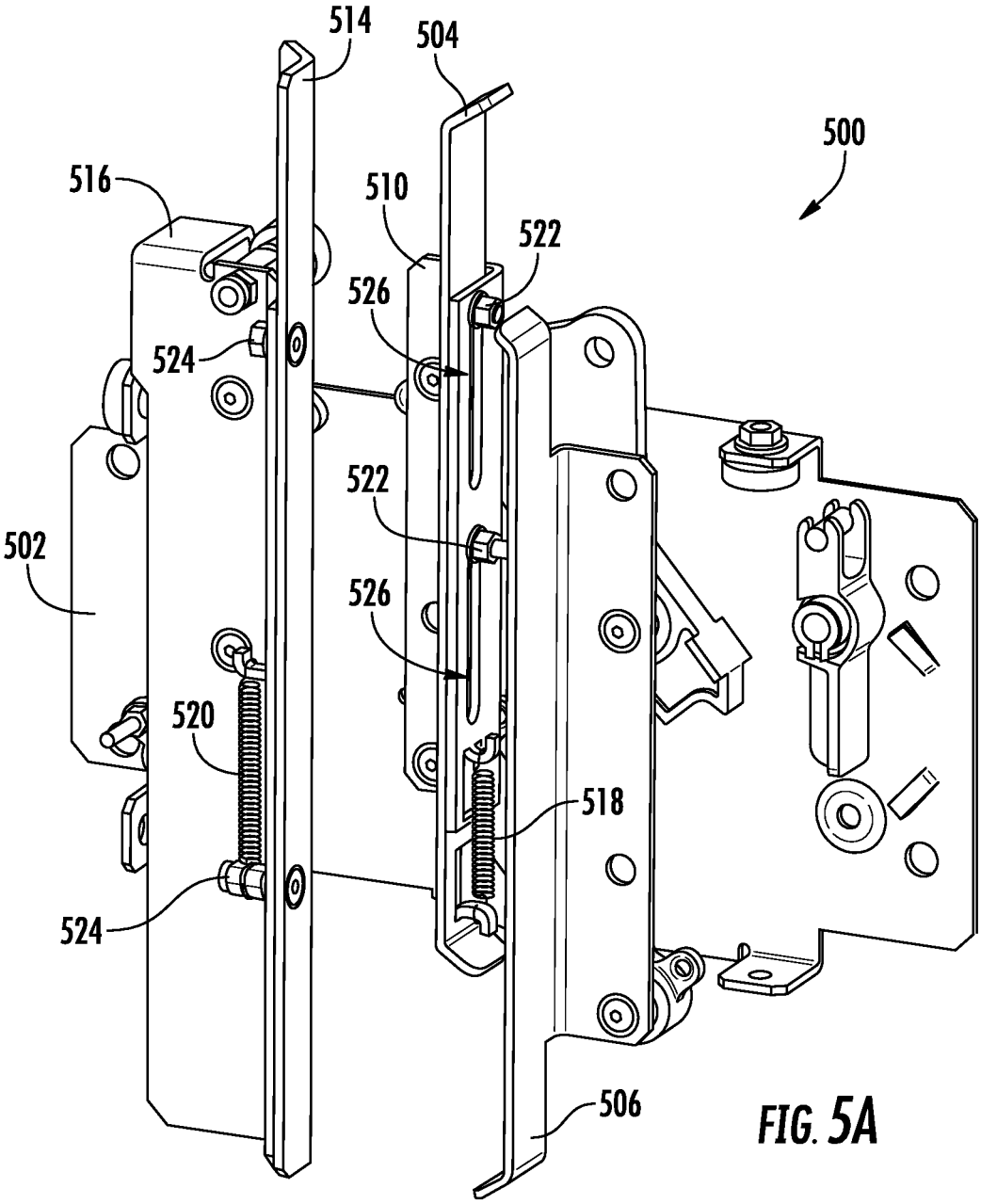
FIG. 5A is an isometric illustration showing the structure of a movable first blade of a movable elevator car door coupling in accordance with an embodiment of the present disclosure.
Figure 5B:
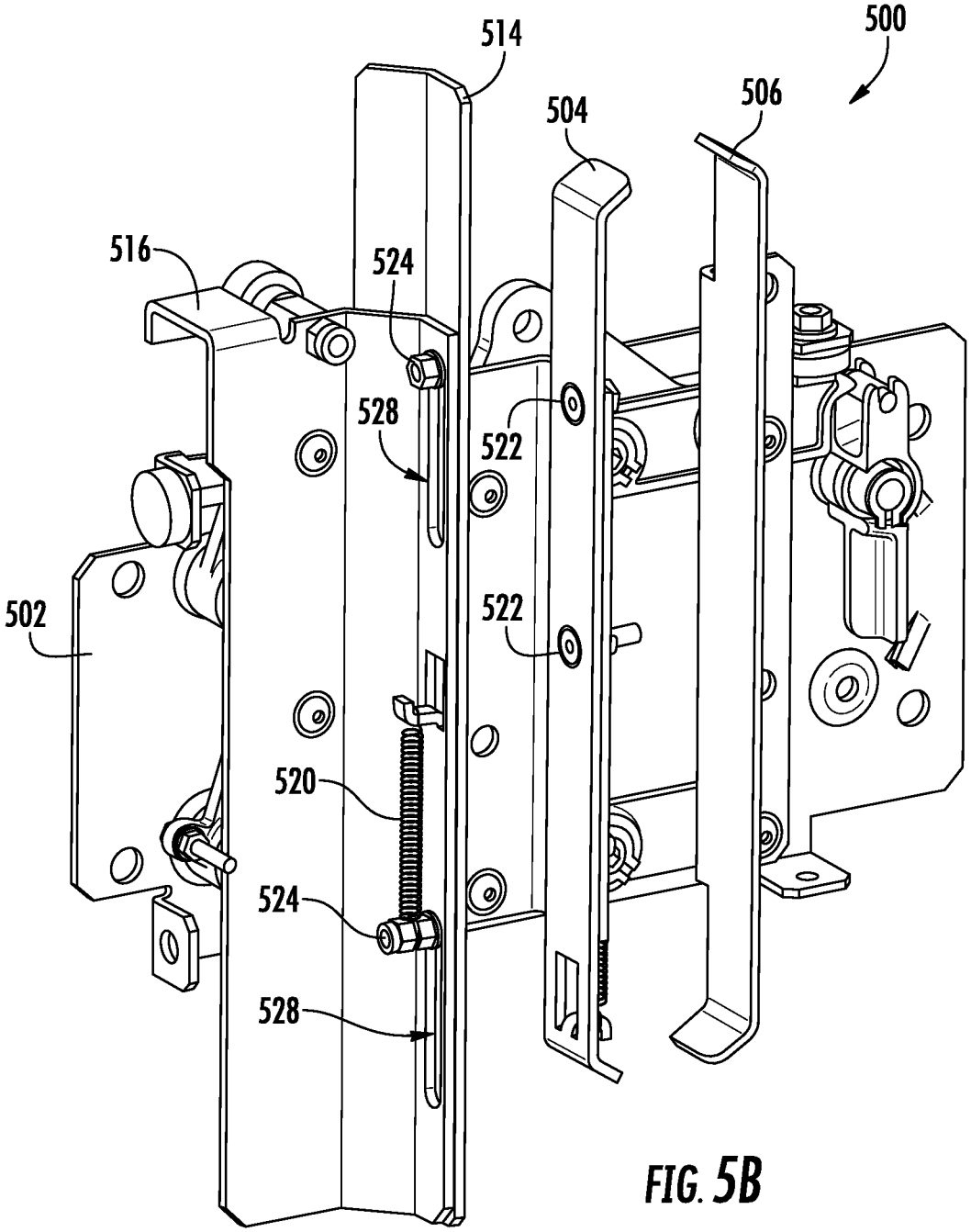
FIG. 5B is an isometric illustration showing the structure of a movable deterrent of the movable elevator car door coupling of FIG. 5A.
Figure 5C:
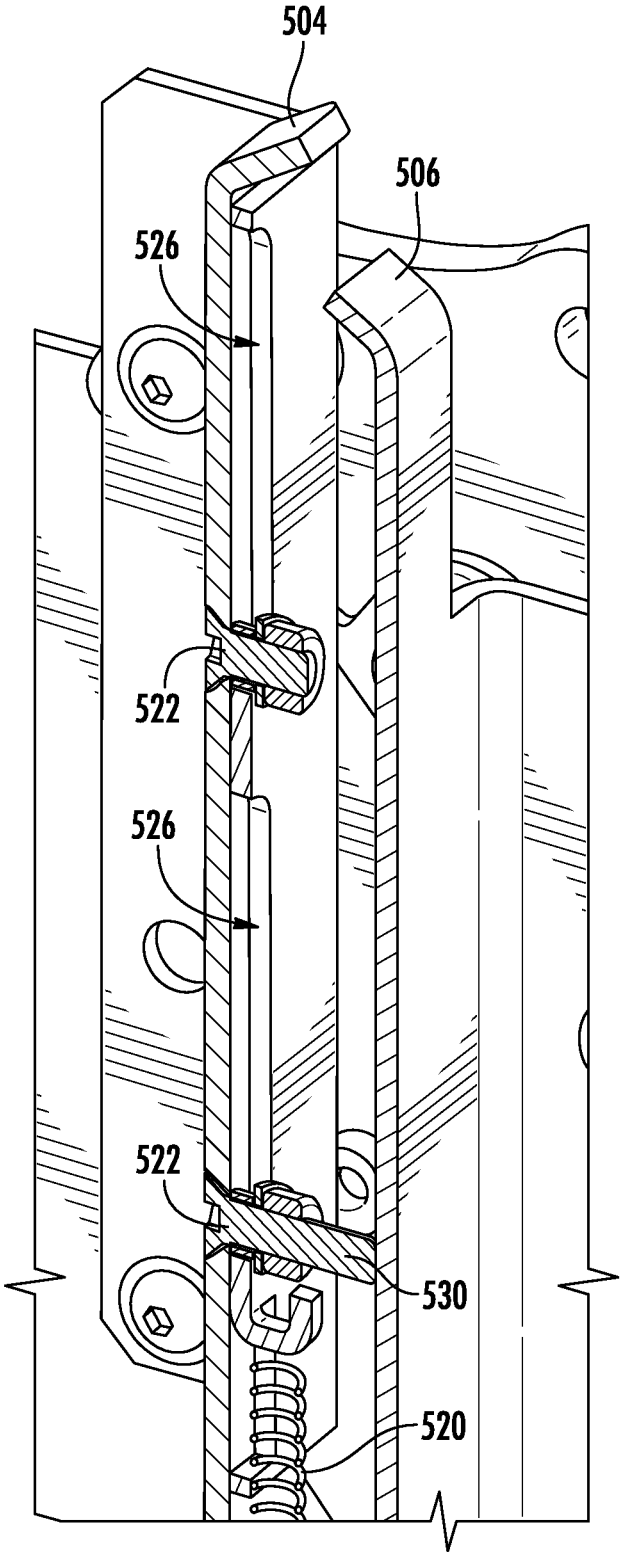
FIG. 5C is an enlarged, sectional illustration of the movable first blade of FIG. 5A.

Turning now to FIGS. 5A-5C, schematic illustrations of a movable elevator car door coupling 500 in accordance with an embodiment of the present disclosure are shown. FIG. 5A is an isometric illustration showing the structure of a movable first blade 504, FIG. 5B is an isometric illustration showing the structure of a movable deterrent 514, and FIG. 5C is an enlarged, sectional illustration of the movable first blade 504. The movable elevator car door coupling 500 is similar to that shown and described above with respect to FIGS. 3A-4B, and thus similar features may not be labeled or described in detail again. As shown in FIGS. 5A-5C, one or more first connectors 522 are arranged to connect the first blade 504 to a respective first blade support 510 and one or more second connectors 524 are arranged to connect the deterrent 514 to a deterrent support 516.

As shown in FIG. 5A, the movable first blade 504 is movably attached to a first blade support 510, with the first blade support 510 fixedly connected to a mounting bracket 502. The connection between the first blade 504 and the first blade support 510 is provided using the first connectors 522. The first connectors 522 may be screws, bolts, or other element that may allow for supported yet movable connection between the first blade 504 and the first blade support 510. The first connectors 522 are arranged to translate or move along one or more respective first slots or tracks 526 formed in the first blade support 510. Further, a first biasing element 518 engages with and connects the first blade 504 to the first blade support 510 and is arranged to provide a restoration force to the movable first blade 504. At least one of the first connectors 522 is arranged with a predefined length in order to ensure proper separation and/or spacing between the first blade 504 and a second blade 506, as shown in FIG. 5C.

As shown in FIG. 5B, the movable deterrent 514 is movably attached to deterrent support 516, with the deterrent support 516 fixedly connected to the mounting bracket 502. The connection between the deterrent 514 and the deterrent support 516 is provided using the second connectors 524. The second connectors 524 may be screws, bolts, or other element that may allow for supported yet movable connection between the deterrent 514 and the deterrent support 516. The second connectors 524 are arranged to translate or move along one or more respective second slots or tracks 528 formed in the deterrent support 516. Further, a second biasing element 520 engages with and connects the deterrent 514 to the deterrent support 516 and is arranged to provide a restoration force to the movable deterrent 514.

As noted above, one of the first connectors 522 may be arranged to ensure a separation or spacing between the first blade 504 and the second blade 506. For example, as shown in FIG. 5C, one of the first connectors 522 has a connector extension 530 that operates as a spacer between the first and second blades 504, 506. Although shown with a single first connector having the connector extension 530, in some embodiments all first connectors 522 may include a connector extension 530.

Figure 6A:
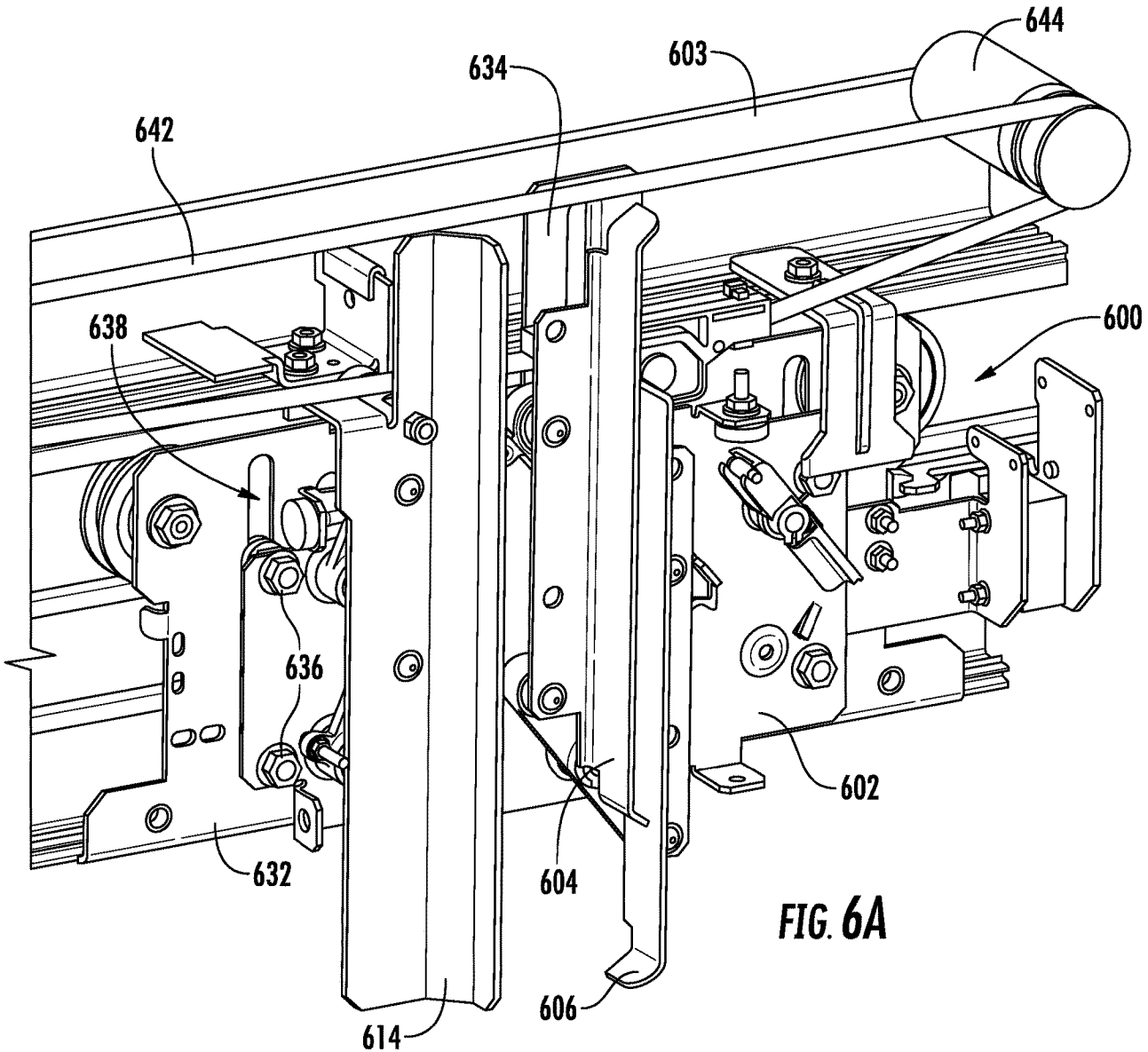
FIG. 6A is a schematic illustration of a movable elevator car door coupling in accordance with an embodiment of the present disclosure.
Figure 6B:
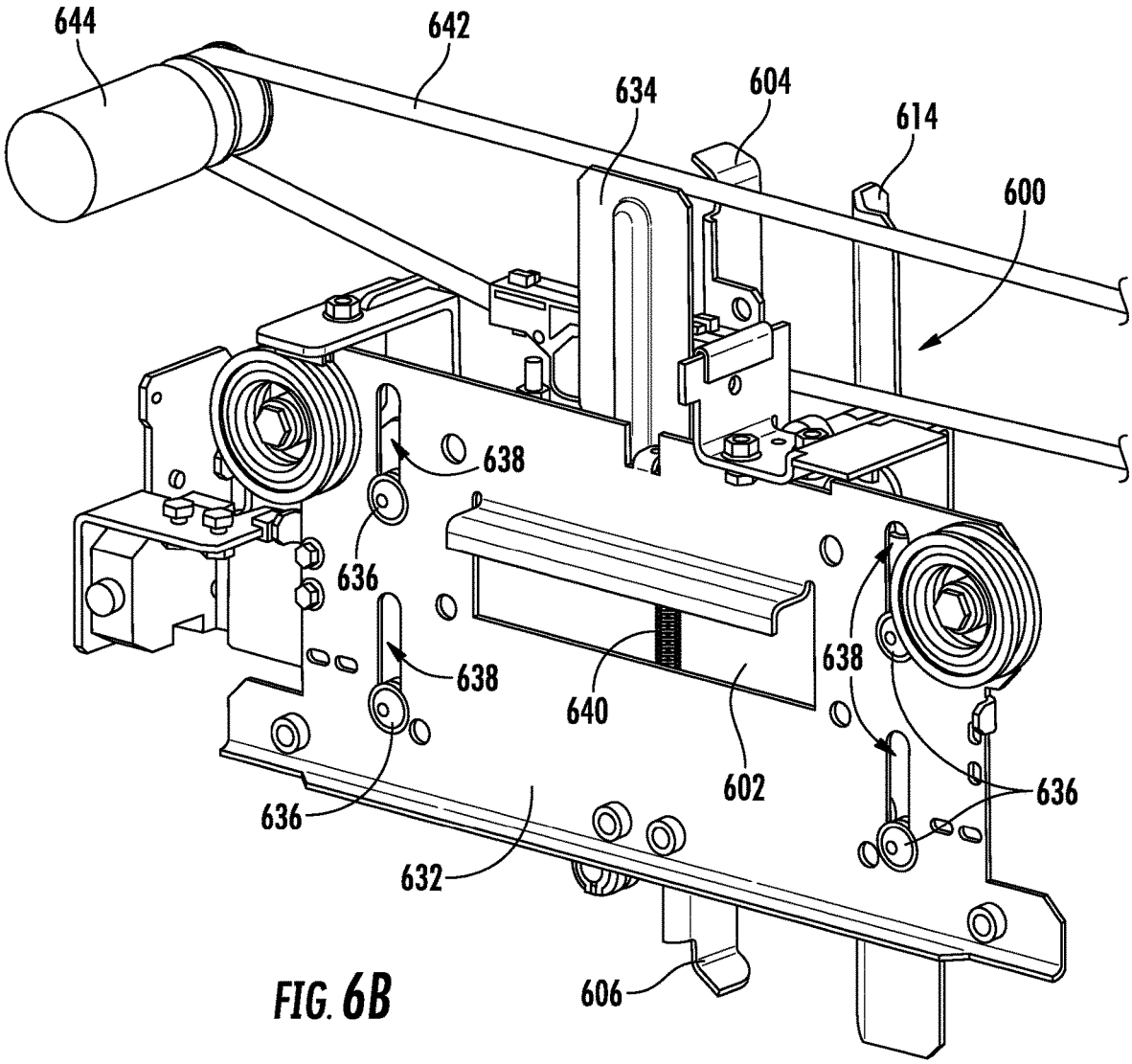
FIG. 6B is an alternative view illustrating the movable elevator car door coupling of FIG. 6A.

Turning now to FIGS. 6A-6B, schematic illustrations of a movable elevator car door coupling 600 in accordance with an embodiment of the present disclosure are shown. The movable elevator car door coupling 600 in this embodiment has similar elements as described above, having a mounting bracket 602, a first blade 604, a second blade 606, and a deterrent 614. The movable elevator car door coupling 600 is attached to an elevator car 603 by a secondary mounting bracket 632. In this embodiment, the secondary mounting bracket 632 is fixedly attached to the elevator car 603 and the mounting bracket 602 is movably attached to the secondary mounting bracket 632.

As shown in FIGS. 6A-6B, the mounting bracket 602 includes a bracket extension 634. The bracket extension 634 extends a distance above the mounting bracket 602, and extends a distance beyond an extent of the first blade 604 and the deterrent 614. The bracket extension 634 is arranged to contact a ceiling of an elevator shaft and in response to such contact, urge the mounting bracket 602 downward, with all attached components moving with the mounting bracket 602. For example, as shown, the mounting bracket 602 is movably attached to the secondary mounting bracket 632 by one or more bracket connectors 636. The bracket connectors 636 are arranged to move along or through respective slots or tracks 638 formed in the secondary mounting bracket 632.

A biasing element 640 connects the mounting bracket 602 to the secondary mounting bracket 632 to apply a restoring force to return the mounting bracket 602 to a normal position if a force is applied to the bracket extension 634 that moves the mounting bracket 602. In normal operation, the biasing element 640 does not impact or affect operation of the movable elevator car door coupling 600. That is, the biasing element 640 does not interfere with operation of the couplings and elevator door operations. However, as described herein, if an overrun event or other situation occurs wherein the elevator car approaches the top of the elevator shaft, the biasing elements 318, 320 enable portions of the movable elevator car door coupling 300 to move to prevent damage thereto.

As shown, a belt 642 and an operator 644 of an elevator car door coupling are shown relative to the movable elevator car door coupling 600. The operator 644 and belt 642 are attached to the elevator car 603, as known in the art. The belt 642 connects to or passes through a portion of the movable elevator car door coupling 600, and thus when the movable elevator car door coupling 600 moves, the belt 642 will stretch, as illustratively shown.

Figure 7A:
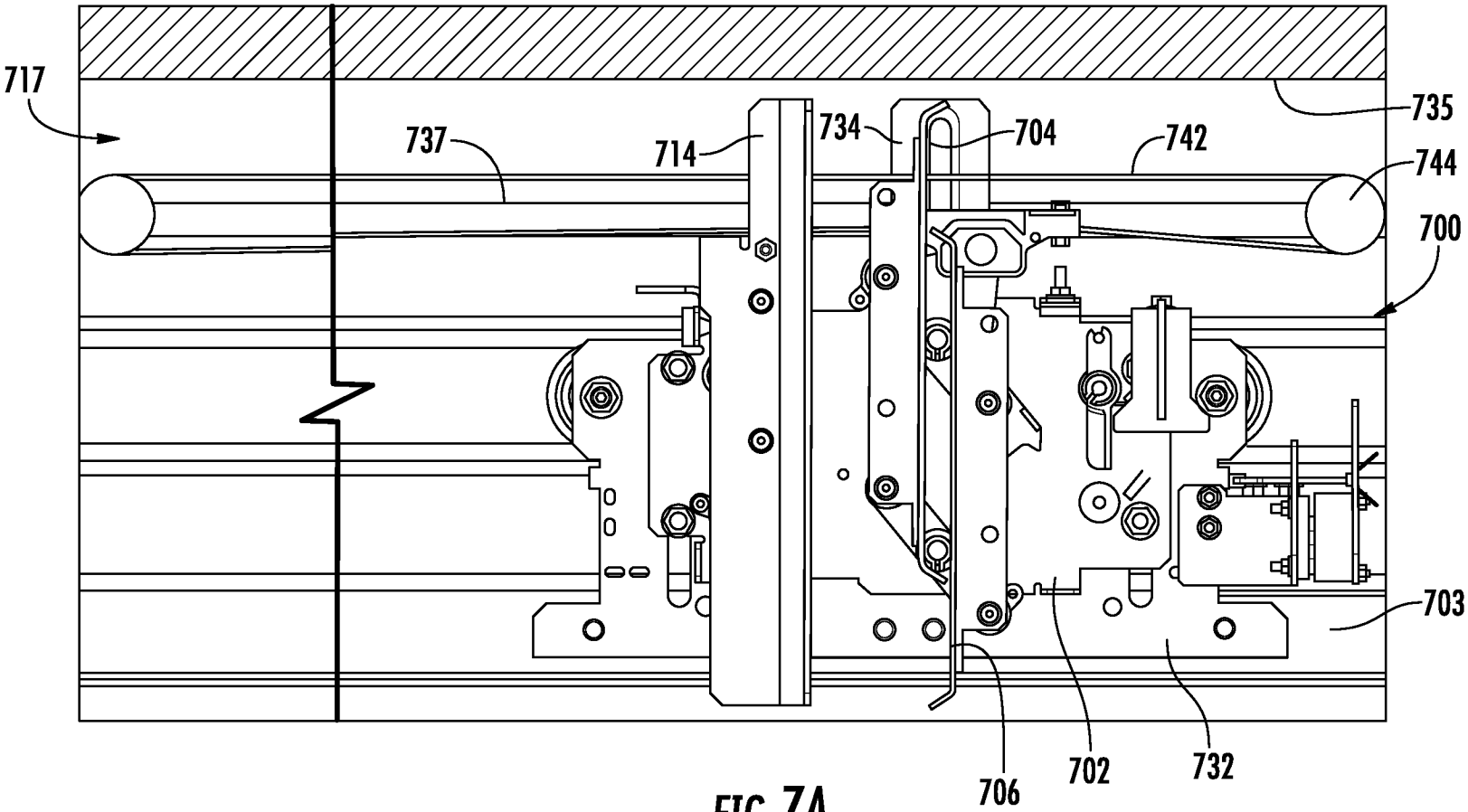
FIG. 7A illustrates a movable elevator car door coupling in accordance with an embodiment of the present disclosure in a first position, at the start of contact with a ceiling of an elevator shaft.
Figure 7B:
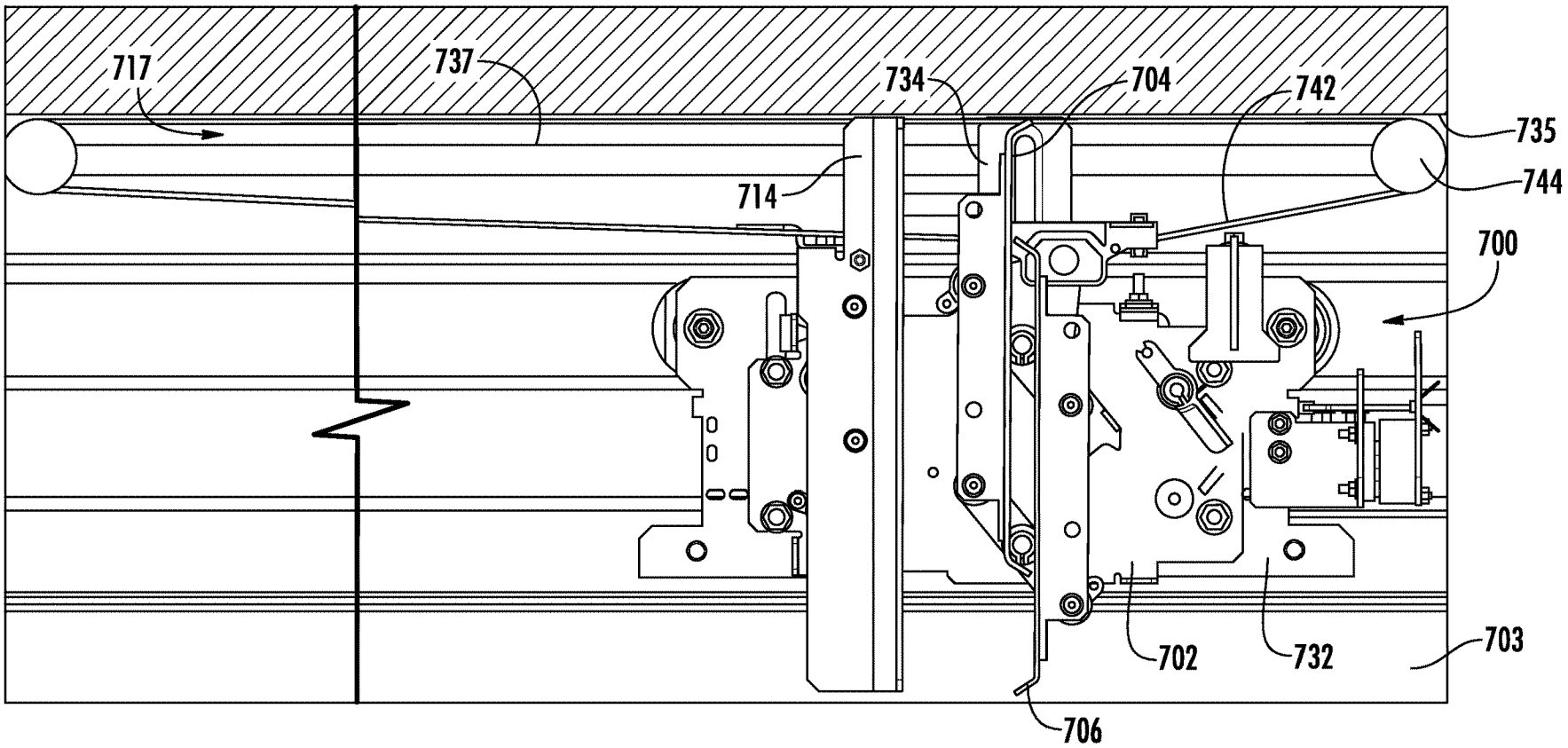
FIG. 7B illustrates the movable elevator car door coupling of FIG. 7A in a second position, after contact and further movement of the elevator car occurs.

Turning now to FIGS. 7A-7B, schematic illustrations of a movable elevator car door coupling 700 mounted to an elevator car 703 in accordance with an embodiment of the present disclosure are shown. FIG. 7A illustrates the movable elevator car door coupling 700, in a first position, at the start of contact with a ceiling 735 of an elevator shaft 717. FIG. 7B illustrates the movable elevator car door coupling 700 in a second position, after contact and further movement of the elevator car 703 occurs. As shown in FIG. 7B, parts of the movable elevator car door coupling 700 move to allow for the movement of the elevator car 703 relative to the ceiling 735.

The movable elevator car door coupling 700 is similar to that shown and described above with respect to FIGS. 6A-6B. For example, the movable elevator car door coupling 700 includes a mounting bracket 702 movably attached to a secondary mounting bracket 732 and is mounted to the elevator car 703. The movable elevator car door coupling 700 includes a first blade 704, a second blade 706, and a deterrent 714, as described above. The mounting bracket 702 includes a bracket extension 734 that extends above the first blade 704 and the deterrent 714 such that the bracket extension 734 defines the highest point or surface of movable elevator car door coupling 700. As shown, in the normal operation position (FIG. 7A), the first blade 704, the deterrent 714, and the bracket extension 734 extend above a top 737 of the elevator car 703.

However, during an overrun event, such as shown in FIG. 7B, the mounting bracket 702 (along with the attached components) is moved relative to the secondary mounting bracket 732 and thus relative to the elevator car 703 to allow the top 737 of the elevator car 403 to move closer to the ceiling 735 of the elevator shaft 717. As illustratively shown in FIG. 7B, the mounting bracket 702 is moved downward relative to the secondary mounting bracket 732 because of contact between the bracket extension 734 and the ceiling 735. The ceiling 735 contacts the bracket extension 734 which forces the mounting bracket 702 to move, applying pressure or force against a biasing element (not shown). The extended biasing element will apply a biasing force such that when the elevator car 703 moves away from the ceiling 735 of the elevator shaft 717, the mounting bracket 702 will be returned to the normal position (shown in FIG. 7A). That is, the biasing element applies a restoring force to return the mounting bracket 702 to the normal operation position after an overrun or other contact and force is applied to the bracket extension 734 of the mounting bracket 702.

As shown in FIG. 7B, a belt 742 is extended or stretched downward as the mounting bracket 702 is moved downward. However, the operator 744 does not move, as it is fixed to the elevator car. The bracket extension 734 is arranged such that it extends slightly higher relative to the top 737 of the elevator car 703 than the operator 744, even in a fully depressed position (e.g., as shown in FIG. 7B).

Advantageously, embodiments provided herein provide for elevator car door couplings which enable reduced space occupied by elevator systems. The elevator car door coupling or a part thereof is movable by contacting a ceiling of an elevator shaft. During such contact, the elevator car door coupling or the contacting part will move without damage occurring thereto. That is, the elevator car door coupling or a part thereof will translate vertically if the elevator car door coupling (or part thereof) contacts the ceiling of the elevator shaft. The elevator car door coupling will return to a normal or initial position due to a restoring force applied by a biasing element, such as a spring. Advantageously, the elevator car door coupling is still fully functional even after contact with the ceiling of the elevator shaft.

Advantageously, the elevator car door coupling can be retained at a traditional high point relative to an elevator car, and yet accommodate reduced volume configurations for elevator systems. For example, an overhead security volume can be reduced while maintaining a fully functional elevator car door coupling. Because of the movability of elevator car door couplings of the present disclosure, the elevator car door couplings are still fully functional even after contact with a ceiling of an elevator shaft.

As used herein, the use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity).

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator car door system comprising:

an elevator car having an elevator car door; and a movable elevator car door coupling attached to the elevator car and arranged to control operation of the elevator car door, the movable elevator car door coupling comprising:

a mounting bracket attached to the elevator car;

a first blade attached to the mounting bracket;

a second blade attached to the mounting bracket; and a vertical bar deterrent attached to the mounting bracket, the vertical bar deterrent positioned and configured to prevent unauthorized access and opening of the elevator car door, wherein the first and second blades are operable to engage with a landing door coupling to operate the elevator car door, wherein, during normal operation and in a locked position, the first blade and the vertical bar deterrent extend above the mounting bracket; and wherein a portion of the movable elevator car door coupling is arranged to contact a ceiling of an elevator shaft during an overrun event, wherein, when the portion contacts the ceiling, at least the vertical bar deterrent translates vertically relative to the elevator car and translates vertically away from the ceiling, and when the portion is not in contact with the ceiling, a biasing element urges the portion vertically toward a normal position.

2. The elevator car door system of claim 1, wherein the portion comprises the first blade.

3. The elevator car door system of claim 2, further comprising a first blade support fixedly connected to the mounting bracket, wherein the first blade is moveably connected to the first blade support.

4. The elevator car door system of claim 3, wherein the biasing element connects the first blade to the first blade support.

5. The elevator car door system of claim 3, further comprising at least one connector arranged to moveably connect the first blade to the first blade support.

6. The elevator car door system of claim 4, further comprising at least one connector arranged to moveably connect the first blade to the first blade support.

7. The elevator car door system of claim 6, wherein the first blade support defines a slot and the at least one connector moves along the slot when the first blade is moved due to contact with the ceiling of the elevator shaft.

8. The elevator car door system of claim 6, wherein the at least one connector includes a connector extension arranged to maintain a separation of the first blade from the second blade.

9. The elevator car door system of claim 7, wherein the at least one connector includes a connector extension arranged to maintain a separation of the first blade from the second blade.

10. The elevator car door system of claim 1, wherein the portion comprises the deterrent.

11. The elevator car door system of claim 10, further comprising a deterrent support fixedly connected to the mounting bracket, wherein the deterrent is moveably connected to the deterrent support.

12. The elevator car door system of claim 11, wherein the biasing element connects the first blade to the first blade support.

13. The elevator car door system of claim 11, further comprising at least one connector arranged to moveably connect the first blade to the first blade support.

14. The elevator car door system of claim 12, further comprising at least one connector arranged to moveably connect the first blade to the first blade support.

15. The elevator car door system of claim 14, wherein the first blade support defines a slot and the at least one connector moves along the slot when the first blade is moved due to contact with the ceiling of the elevator shaft.

16. The elevator car door system of claim 1, wherein the portion comprises a bracket extension of the mounting bracket.

17. The elevator car door system of claim 16, further comprising a secondary mounting bracket, wherein the secondary mounting bracket is fixedly connected to the elevator car and the mounting bracket is movably mounted to the secondary mounting bracket.

18. The elevator car door system of claim 17, wherein the biasing element connects the mounting bracket to the secondary mounting bracket.

* * * * *